US009316386B2

(12) United States Patent
Breidenassel et al.

(10) Patent No.: US 9,316,386 B2
(45) Date of Patent: Apr. 19, 2016

(54) SEMICONDUCTOR LAMP HAVING TWO GROUPS OF LEDS CORRESPONDING TO UPPER AND LOWER SIDES OF A REFLECTOR

(75) Inventors: Nicole Breidenassel, Bad Abbach (DE); Johannes Hoechtl, Eichstaett (DE); Fabian Reingruber, Munich (DE); Henrike Streppel, Regensburg (DE)

(73) Assignee: OSRAM GMBH, Munich (DE)

( * ) Notice: Subject to any disclaimer, the term of this patent is extended or adjusted under 35 U.S.C. 154(b) by 131 days.

(21) Appl. No.: 13/884,018

(22) PCT Filed: Nov. 4, 2011

(86) PCT No.: PCT/EP2011/069422

§ 371 (c)(1),
(2), (4) Date: May 8, 2013

(87) PCT Pub. No.: WO2012/065861

PCT Pub. Date: May 24, 2012

(65) Prior Publication Data

US 2013/0229801 A1 Sep. 5, 2013

(30) Foreign Application Priority Data

Nov. 15, 2010 (DE) ..... 10 2010 043 918

(51) Int. Cl.
*F21K 99/00* (2010.01)
*F21V 29/00* (2015.01)
(Continued)

(52) U.S. Cl.
CPC ..... *F21V 29/002* (2013.01); *F21K 9/135* (2013.01); *F21V 3/02* (2013.01); *F21V 29/505* (2015.01);
(Continued)

(58) Field of Classification Search
CPC ..... F21V 7/04; F21V 7/0008; F21V 7/0066; F21V 29/002; F21V 29/004; F21K 9/10; F21K 9/13; F21K 9/54; F21K 9/135; F21Y 2101/02
USPC ..... 362/249.02, 247
See application file for complete search history.

(56) References Cited

U.S. PATENT DOCUMENTS 5,929,788 A 7/1999 Vukosic
6,932,496 B2 * 8/2005 Rizkin ..... B64F 1/205 362/183

(Continued)

FOREIGN PATENT DOCUMENTS

CN 1762061 A 4/2006
CN 1876500 A 12/2006

(Continued)

OTHER PUBLICATIONS

Chinese Office Action for application 201180054935.2 (5 pages) dated Nov. 15, 2014.

(Continued)

*Primary Examiner* — Robert May
(74) *Attorney, Agent, or Firm* — Viering, Jentschura & Partner mbB

(57) ABSTRACT

A semiconductor lamp includes a reflector having a lower side and an upper side, wherein the lower side widens laterally and wherein the lower side and the upper side are separated from one another by an upper rim, and having a first light source group having at least one semiconductor light source and a second light source group having at least one semiconductor light source, wherein the reflector is provided as a cooling body for the first light source group and for the second light source group; wherein at least a part of a light that can be emitted by the first light source group can be reflected by means of the lower side of the reflector at least into a spatial angle range that cannot be directly illuminated by the first light source group.

17 Claims, 7 Drawing Sheets

Fig.1

(51) Int. Cl.

| | |
|---|---|
| ***F21V 3/02*** | (2006.01) |
| ***F21V 29/505*** | (2015.01) |
| ***F21V 29/83*** | (2015.01) |
| *F21Y 101/02* | (2006.01) |
| *F21Y 113/00* | (2006.01) |
| *F21V 29/506* | (2015.01) |

(52) U.S. Cl.
CPC ..... *F21V 29/83* (2015.01); *F21V 29/506* (2015.01); *F21Y 2101/02* (2013.01); *F21Y 2113/00* (2013.01)

(56) References Cited

U.S. PATENT DOCUMENTS

| | | | | |
|---|---|---|---|---|
| 7,347,586 | B2 * | 3/2008 | Izardel | 362/247 |
| 7,758,223 | B2 * | 7/2010 | Osawa et al. | 362/547 |
| 8,143,769 | B2 * | 3/2012 | Li | 313/46 |
| 8,240,880 | B2 * | 8/2012 | Chen | F21S 8/06 362/235 |
| 2005/0111234 | A1 | 5/2005 | Martin et al. | |
| 2006/0250792 | A1 | 11/2006 | Izardel | |
| 2007/0002572 | A1 | 1/2007 | Ewig et al. | |
| 2009/0021931 | A1 | 1/2009 | Mayer et al. | |
| 2010/0301353 | A1 * | 12/2010 | Pabst et al. | 257/88 |
| 2011/0103054 | A1 * | 5/2011 | Chang et al. | 362/235 |
| 2012/0241778 | A1 | 9/2012 | Franck et al. | |
| 2012/0300455 | A1 | 11/2012 | Breidenassel et al. | |

FOREIGN PATENT DOCUMENTS

| | | | |
|---|---|---|---|
| CN | 2859195 | Y | 1/2007 |
| CN | 101802488 | A | 8/2010 |
| CN | 101813246 | A | 8/2010 |
| DE | 20215538 | U1 | 4/2003 |
| DE | 102004025473 | A1 | 6/2005 |
| DE | 102005042358 | B3 | 3/2007 |
| DE | 102009048313 | A1 | 4/2011 |
| DE | 102010001047 | A1 | 7/2011 |
| JP | 10031905 | A | 2/1998 |
| WO | 2009012314 | A1 | 1/2009 |

OTHER PUBLICATIONS

English language abstract of DE 202 15 538 dated Apr. 10, 2003.
English language abstract of DE 10 2005 042 358 B3 dated Mar. 1, 2007.
English language abstract of DE 10 2004 025 473 A1 dated Jun. 23, 2005.
English language abstract of JP 10 031 905 A dated Feb. 3, 1998.
German Office Action based on application No. 10 2010 043 918.5 (4 pages) dated Sep. 8, 2015.

* cited by examiner

SEMICONDUCTOR LAMP HAVING TWO GROUPS OF LEDS CORRESPONDING TO UPPER AND LOWER SIDES OF A REFLECTOR

RELATED APPLICATIONS

The present application is a national stage entry according to 35 U.S.C. §371 of PCT application No.: PCT/EP2011/069422 filed on Nov. 4, 2011, which claims priority from German application No.: 10 2010 043 918.5 filed on Nov. 15, 2010.

TECHNICAL FIELD

Various embodiments relate to a semiconductor lamp, in particular a retrofit lamp, having a plurality of semiconductor light sources and at least one reflector.

BACKGROUND

Many LED lamps have light emission oriented strongly into a forward half space. In particular for incandescent lamp-retrofit lamps or in the field of medical technology, however, more strongly omnidirectional emission is desired. However, sufficient cooling of critical components, in particular the light-emitting diodes, must also be ensured. These two requirements compete with one another. The necessity for larger cooling bodies significantly restricts the freedom for solutions having omnidirectional emission. In particular for retrofit lamps, the external dimensions of the lamps to be replaced are to be maintained.

SUMMARY

Various embodiments provide a semiconductor lamp, in particular a retrofit lamp, having a plurality of semiconductor light sources, which allows effective cooling of the semiconductor light sources while simultaneously having light emission into a large spatial angle range.

Various embodiments provide a semiconductor lamp, wherein the semiconductor lamp has at least one reflector having a lower side and an upper side, wherein the lower side widens laterally and wherein the lower side and the upper side are separated from one another by a rim ("upper rim"). The semiconductor lamp also has a first light source group having at least one semiconductor light source and a second light source group having at least one (other) semiconductor light source. The reflector is provided as a cooling body for the first light source group and/or for the second light source group. At least a part of a light that can be emitted by the first light source group (or the associated at least one semiconductor light source, respectively) can be reflected by means of the lower side of the reflector at least into a spatial region that cannot be directly illuminated by the first light source group. The second light source group is configured for the purpose of illuminating at least one shaded region of the reflector in relation to the first light source group. The upper rim of the reflector is designed as a cooling surface.

This semiconductor lamp thus has the advantage that the spatial angle range which can be illuminated by the first light source group can be greatly enlarged. The at least partial shading of the first light source group caused by the reflector can be compensated for simultaneously by the second light source group. Overall, the spatial angle range which can be illuminated by the entire semiconductor lamp can therefore be greatly enlarged.

In addition, the reflector allows light emission which is homogeneous to a high degree for practical purposes.

Because the rim of the reflector is designed as a cooling surface, amplified heat dissipation and therefore more effective cooling of the semiconductor light sources is achieved. For its function as a cooling body, the reflector is connected with good thermal conductivity in particular to the light source group or groups to be cooled thereby. Due to the additional cooling surface in the bulb region, the need for a larger bulb having more undercut for improved omnidirectional emission, which results in shrinking of the typical cooling body, however, can also be compensated for. The cooling surface at the rim of the reflector can be designed both as smooth and also as structured (ribs, lamellae, cooling pins, etc.).

The spatial angle range illuminated by the second light source group can alternatively partially illuminate or completely illuminate the spatial angle range of the first light source group which is shaded by the reflector. The first light source group and the second light source groups may also jointly illuminate a predetermined spatial angle range (outside the shaded spatial angle range).

The semiconductor light sources of the first light source group and the second light source group may be of the same type in particular.

The semiconductor light sources of the first light source group and the second light source group may be aligned in particular in the same direction, in particular parallel to a longitudinal axis of the lamp and/or the reflector. The longitudinal axis of the reflector may also correspond in particular to a longitudinal axis of the lamp; the reflector may thus represent a concentrically arranged part of the lamp. The longitudinal axis of the reflector may in particular also represent its axis of symmetry.

The at least one semiconductor light source preferably includes at least one light-emitting diode. If a plurality of light-emitting diodes are provided, these can illuminate in the same color or in different colors. A color may be monochrome (e.g., red, green, blue, etc.) or multichrome (e.g., white). The light emitted by the at least one light-emitting diode may also be infrared light (IR-LED) or ultraviolet light (UV-LED). A plurality of light-emitting diodes may generate a mixed light; e.g., a white mixed light. The at least one light-emitting diode may contain at least one wavelength-converting fluorescent substance (conversion LED). The at least one light-emitting diode may be provided in the form of at least one individually housed light-emitting diode or in the form of at least one LED chip. A plurality of LED chips can be installed on a shared substrate ("submount"). The at least one light-emitting diode may be equipped with at least one separate and/or shared optic for beam guiding, e.g., with at least one Fresnel lens, collimator, etc. Instead of or in addition to inorganic light-emitting diodes, for example, based on InGaN or AlInGaP, in general organic LEDs (OLEDs, e.g., polymer OLEDs) are also usable. Alternatively, the at least one semiconductor light source can have, for example, at least one diode laser.

Light-emitting diodes typically emit into a half space, which is a front half space in particular here, which is centered around a longitudinal axis of the reflector and/or the lamp. Therefore, if the semiconductor light sources of the first light source group emit into the front half space, the reflector can reflect a part of the light which may be emitted by the first light source group at least into a part of the rear or back half space complementary thereto.

In one embodiment, the upper rim is implemented as a broad rim at least in the form of a ring sector. The rim may be implemented in particular as a peripheral ring-shaped rim. The rim may be implemented in particular as a rim in the form of a spherical segment.

In another embodiment, the semiconductor lamp has a two-part light-transmissive bulb having a first bulb part and a second bulb part, wherein the first bulb part covers the first light source group and the second bulb part covers the second light source group, and the first bulb part and the second bulb part are separated from one another by the upper rim of the reflector. The rim of the reflector may thus be directly in contact with the environment, in particular the ambient air, which allows particularly good heat dissipation to the environment. Particularly flexible shaping of the bulb is thus also made possible.

The bulb parts are in particular implemented as substantially rotationally symmetrical for simple production.

The first bulb part may be implemented in particular substantially in the form of a spherical segment. The first bulb part may extend to the back or in the rear direction beyond an equator or region of greatest lateral extension and thus allow particularly broad illumination of the rear half space. Such a first bulb part may also be assembled easily.

The second bulb part may be implemented in particular substantially in the form of a spherical cap.

Alternatively, the rim may also be covered by a bulb (which is then in one piece, for example), so that the heat dissipation would occur from the rim onto the bulb.

The bulb, in particular the bulb parts, may be manufactured from glass, glass ceramic, other light-transmissive ceramic, or from light-transmissive plastic.

The bulb, in particular the bulb parts, may be diffuse or transparent, wherein the bulb parts may also be designable differently (transparent/diffuse).

The bulb, in particular the bulb parts, may have at least one illuminant for wavelength conversion (frequently also called a "phosphor").

In another embodiment, the second bulb part may be latchable with the reflector. This results in the advantage of a simple construction. The second bulb part may in particular be latched with its rim in a groove, in particular in a peripheral ring groove, of the reflector.

In one alternative embodiment, the reflector flatly contacts an inner side of a one-piece bulb using its upper rim. The heat dissipation to the environment then occurs through the bulb. This embodiment is particularly simple and cost-effective. In one embodiment, which is particularly preferred for assembly, a lower rim of the bulb then at least approximately corresponds to its region of greatest lateral extension (equator).

Furthermore, in one embodiment, the semiconductor lamp has at least one first substrate, wherein the reflector and at least the first light source group are arranged on a front side of the at least one first substrate. The first substrate may be in particular a printed circuit board ("first printed circuit board").

In one refinement, the reflector is arranged or fastened on the front side of the at least one first substrate, which promotes simple assembly. The reflector may have a (lower) attachment surface for this purpose, which is provided for the attachment on the first substrate.

The reflector may be attached by means of its lower attachment surface directly onto the printed circuit board. For an improved thermal attachment, in particular if the reflector is provided as a cooling body for semiconductor light sources arranged on the at least one first substrate, a thermal interface material (TIM), for example, a thermal conduction film or a thermal conduction paste, may be provided between the reflector and the at least one first substrate.

Alternatively, the at least one first substrate can enclose the reflector, for example, in a ring shape.

Also, in one refinement, the at least one first substrate rests with its rear side flatly on a (rear) cooling body, optionally via a TIM material. This allows cooling of the semiconductor light sources arranged on the at least one first substrate. The reflector may then cause an additional cooling effect, so that the cooling body may be implemented as comparatively small, which in turn improves light emission into a rear or back half space. The reflector may alternatively or additionally be used for cooling semiconductor light sources attached thereon, in particular the second light source group. The first bulb part may thus also be easily clamped between the reflector and the cooling body for the fastening thereof. The reflector can also rest or be seated directly on the cooling body, optionally via a thermal interface material.

For example, a base for the electrical contacting of the lamp with a matching socket may adjoin the cooling body on a rear end facing away from the printed circuit board.

Also, in one embodiment, the second light source group is arranged on the upper side of the reflector. The upper side may be implemented for this purpose in particular as an at least locally level surface, which is aligned in particular parallel to the first substrate. The semiconductor light sources of the second light source group are thus arranged on a different (second) plane in relation to the longitudinal axis of the reflector or the lamp, respectively, than the semiconductor light sources of the first light source group, which are arranged on a first plane. This embodiment has the advantage that the second light source group (or its at least one semiconductor light source) may emit its light substantially unobstructed through the reflector. In addition, the reflector may thus be used as a particularly effective cooling body for the at least one semiconductor light source of the second light source group attached thereto or thereon. For the case in which the second light source group includes at least one light-emitting diode, by means of the second light source group, for example, the entire front half space may be illuminated or irradiated. Alternatively, the reflector may also be used as a lateral reflector for the second light source group attached thereon, which restricts the associated illuminated spatial angle range, in particular symmetrically to the longitudinal axis.

In general, the light source groups may be arranged on different planes (with respect to the longitudinal axis or a main emission direction or optical axis of the semiconductor light sources) or height levels, e.g., the second light source group on a second plane which is higher than the first plane of the first light source group. More than two planes or levels may also be used, wherein one light source group may also be distributed onto a plurality of planes. Such a refinement, in which the semiconductor light sources are arranged on planes, has the advantage of simple equipping of the semiconductor light sources or the light source groups.

In one further embodiment, the semiconductor lamp has at least one second substrate, in particular at least one second printed circuit board, wherein the second light source group is arranged on a front side of the at least one second substrate, and the at least one second substrate is fastened with its rear side on the reflector.

In one special embodiment, the cooling body has a driver cavity which is lined with an electrically insulating housing, in particular a plastic housing, wherein the housing protrudes through the cooling body and through the first substrate up to the reflector, and the second substrate is screwed together with the housing through the reflector. Thus, in a simple manner, the second substrate may simultaneously be connected to the reflector, the reflector to the first substrate, and the first substrate to the cooling body, whereby a stable connection results and good heat conduction is made possible between the elements.

Furthermore, in one embodiment, the second bulb part has a catch hook, which may be latched behind the second substrate. The second bulb part may thus also be latched on the lamp, specifically in a particularly simple manner which places little mechanical load on the second bulb part. In particular, a catch recess may be introduced into the reflector on the rim of its support surface with the second substrate, in which catch recess the second substrate undercuts. Alternatively, the reflector may also be seated directly on the cooling body and may be latched, glued, or screwed together with it, etc.

In one refinement, the second light source group is arranged on the front side of the first substrate.

In addition, in one embodiment, the reflector is hollow and open on both sides in the longitudinal direction, and the second light source group is laterally enclosed by the reflector. In particular, the second light source group may be arranged here on the front side of the first substrate. The reflector then separates the first light source group and the second light source group on the first substrate. The second light source group may be seated either on the same substrate as the first light source group or on another (second) substrate.

The second light source group may at least partially irradiate the upper side of the reflector. In this case it is advantageous if both the lower side of the reflector, which is irradiated by the light sources of the first group, and also the upper side of the reflector, which is irradiated by the light sources of the second group, are designed as reflective, in particular specular (for example, by polishing, coating, etc.).

Furthermore, in one embodiment, the rear side of the first substrate is attached on a cooling body, the cooling body has a driver cavity lined with an electrically insulating housing, in particular a plastic housing, and the reflector is screwed together with the housing through the printed circuit board and through the cooling body. The lamp may thus be assembled using few screwing procedures. This embodiment is particularly advantageous in conjunction with a semiconductor lamp which has the first substrate, wherein the reflector and at least the first light source group are arranged on a front side of the first substrate, and wherein the reflector is hollow and open on both sides in the longitudinal direction, and the second light source group is laterally enclosed by the reflector.

Alternatively, the reflector may be seated directly on a cooling body, on which the first substrate is also seated. The first substrate may then have a recess for guiding through the cooling body.

In yet another alternative refinement, the reflector may also be arranged "floating" in front of or over the first substrate or the first light source group, respectively, and may be fastened on an inner side of the bulb, for example.

In addition, in one embodiment, the first light source group has a plurality of semiconductor light sources, which are arranged in a ring shape around the reflector. A light emission which is uniform to a high degree may thus be achieved in the circumferential direction around the longitudinal axis.

Furthermore, in one embodiment, the semiconductor lamp is a retrofit lamp. The retrofit lamp is to replace a specific typical lamp, e.g., incandescent lamp, and is not to exceed or is not to substantially exceed an external contour of the typical lamp for this purpose and in addition is to have an identical light emission characteristic as much as possible. The semiconductor lamp may be in particular an incandescent lamp-retrofit lamp, since here the reflector allows a light emission into a rear half space in relation to the longitudinal axis, which is also illuminated in the case of a typical incandescent lamp.

In one refinement, which is advantageous for effective heat spreading and/or heat dissipation, the reflector consists of a material having good conductivity, having a thermal conductivity $\lambda$ of greater than 15 W/(m·K), in particular with $\lambda$>150 W/(m·K), e.g., having aluminum, copper, magnesium, or an alloy thereof, or from a thermally conductive plastic or from ceramic. Fundamentally, however, the use of a simple plastic or glass is also possible.

The lower side of the reflector may be implemented in particular as continuously curved or as a polygon in profile or in cross-section. The lower side of the reflector may be faceted in particular.

In particular if the first light source group and the second light source group are arranged on a shared plane, in particular on a shared substrate, the upper side may be implemented in particular as continuously curved or as a polygon in profile or in cross-section. The upper side of the reflector may be faceted in particular.

In addition, in one embodiment, at least the reflector has at least one cooling channel. The at least one cooling channel preferably extends inside the reflector, for example, in the form of a borehole. The at least one cooling channel may extend at least sectionally in a curve. The at least one cooling channel may preferably continue through the (main) cooling body; the two ends of the at least one (combined) cooling channel are then preferably located on an outer side of the reflector or on an outer side of the (main) cooling body, respectively. The at least one cooling channel may in particular open into the upper rim or have an open end therein. The at least one cooling channel may also extend through a printed circuit board, or the like. The at least one cooling channel improves heat dissipation from the semiconductor lamp.

BRIEF DESCRIPTION OF THE DRAWINGS

The invention is schematically described in greater detail on the basis of exemplary embodiments in the following figures. For the sake of clarity, identical or identically-acting elements can be provided with identical reference numerals.

FIG. 1 shows a front part, in relation to a longitudinal axis L, of a semiconductor lamp 1 according to a first embodiment.

DETAILED DESCRIPTION

Figure 1:
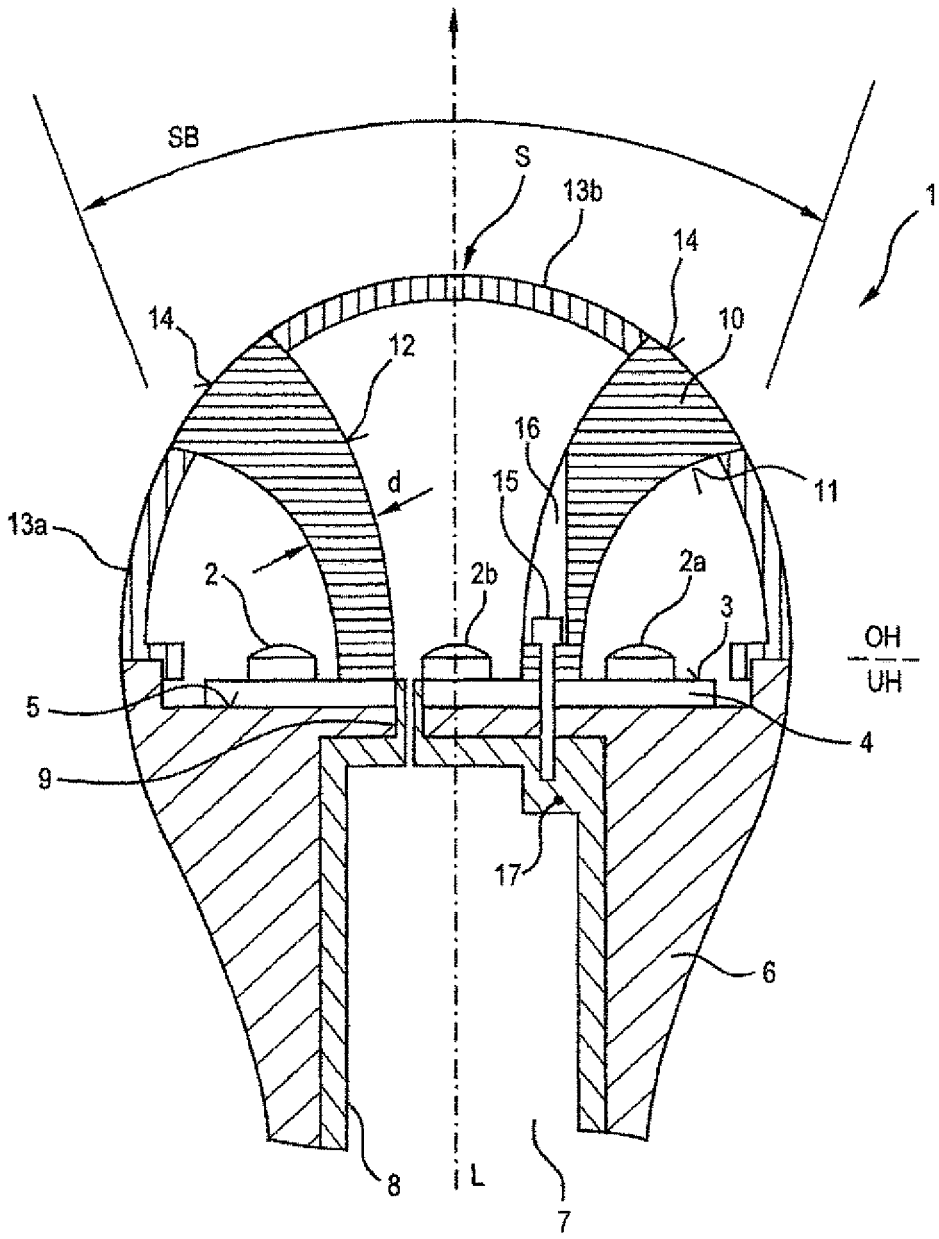
FIG. 1 shows a sectional illustration in a side view of a semiconductor lamp according to a first embodiment.

The following detailed description refers to the accompanying drawings that show, by way of illustration, specific details and embodiments in which the invention may be practiced.

The semiconductor lamp 1 has as light sources a plurality of light-emitting diodes 2*a*, 2*b*, which are arranged on a front side 3 of a shared substrate in the form of a printed circuit board 4. The printed circuit board 4 is perpendicular to the longitudinal axis L, so that the light-emitting diodes 2*a*, 2*b* emit into an upper half space OH spanned in the direction of the longitudinal axis L, which is centered around the longitudinal axis L. The printed circuit board 4 has its rear side 5 resting on a cooling body 6, which has a base for the electrical contacting of the semiconductor lamp 1 on its rear end (not shown) in the direction opposite to the longitudinal axis L.

The cooling body 6 has a driver cavity 7, which is lined so it is electrically insulated by means of a housing 8 made of plastic. Driver electronics (no abbreviation) for operating the light-emitting diodes 2*a*, 2*b* may be housed in the housing 8. For an electrical connection between the driver electronics and the light-emitting diodes 2*a*, 2*b*, the housing 8 has a sleeve-shaped or tubular projection 9 on the front side, which extends through corresponding recesses in the cooling body 6 and the printed circuit board 4 up to the front side 3 of the printed circuit board 4. Cables or other electrical lines may be laid through the projection 9 between the driver cavity 7 and in particular the front side 3 of the printed circuit board 4.

A rotationally-symmetrical reflector 10 is fastened concentrically to the longitudinal axis L on the front side 3 of the printed circuit board 4. The reflector 10 divides the light-emitting diodes 2*a*, 2*b* locally into a first light source group having a plurality of light-emitting diodes 2*a* here, which are arranged outside the reflector 10 in a ring shape on the printed circuit board 4, and a second light source group having at least one light-emitting diode 2*b*, which is arranged inside the reflector 10 or is peripherally enclosed by the reflector 10. The light-emitting diodes 2*a* and 2*b* of the first light source group or the second light source group, respectively, can be activatable jointly as groups or individually. The light-emitting diodes 2*a*, 2*b* may be of the same type or of different types.

The reflector 10 is hollow and open on both sides in the direction of the longitudinal axis L and widens laterally with increasing distance from the printed circuit board 4 up to an upper rim 14. The upper rim 14 separates a lower side 11 of the reflector 10 from an upper side 12 of the reflector 10. The lower side 11 has in particular a surface normal here, which is mostly opposite to the direction of the longitudinal axis L from bottom to top at least in components, while the surface normal of the upper side 12 is in the same direction as the longitudinal axis L at least in components. The lower side 11 arches over the light-emitting diodes 2*a* of the first light source group here. A large part or a majority of the light emitted by the light-emitting diodes 2*a* is thus reflected by means of the (specularly or diffusely) reflecting lower side 11, specifically laterally or at an angle to the longitudinal axis L into the upper half space OH and also into a lower half space UH complementary to the upper half space OH. By means of the lower side 11 of the reflector 10, it is therefore possible to at least partially illuminate the lower half space UH, which cannot be directly illuminated by the light-emitting diodes 2*a* and 2*b*, and to do so with significant luminosity. A part of the light of the light-emitting diodes 2*a* and 2*b* is emitted unreflected into the front or upper half space OH.

Due to the reflector 10, a shaded region SB or a region of the upper half space OH which cannot be illuminated results in relation to the light-emitting diodes 2*a* of the first light source group, since the reflector 10 acts as a screen in this regard. In order to also illuminate this shaded region SB at least in the far field, the at least one light-emitting diode 2*b* of the second light source group is used. The at least one light-emitting diode 2*b* of the second light source group emits directly into the shaded region SB, wherein in a near field above the reflector 10, a region which is illuminated neither by the light-emitting diodes 2*a* nor by the light-emitting diodes 2*b* remains, which, however, becomes smaller with increasing distance from the semiconductor lamp 1 (transition to the far field) and merges into a region which is illuminated both by the light-emitting diodes 2*a* and also by the at least one light-emitting diode 2*b* (overlapping). The upper side 12 of the reflector, which also widens, is also implemented as (specularly or diffusely) reflecting and can reflect a part of the light emitted by the at least one light-emitting diode 2*b* into the upper half space OH, and does so with a comparatively broad angle, so that a more homogeneous brightness distribution results.

While normal incandescent lamps or else LED retrofit incandescent lamps typically have a one-piece bulb arching over them, the semiconductor lamp 1 has a two-part light-transmissive bulb, which has a first bulb part 13*a* and a second bulb part 13*b*. The first bulb part 13*a* is implemented in the form of a shell-like cover in the form of a spherical segment (diffuse or transparent), which is also symmetrical around the longitudinal axis L. For its assembly, the first bulb part 13*a* may be placed on an upper rim of the cooling body 6, and subsequently the reflector 10 can be put on such that the upper free rim of the first bulb part 13*a* and the lower side 11 of the reflector 10 contact one another. The contact region in relation to the lower side 11 of the reflector 10 is preferably located on a rim region of the lower side 11 close to the transition to or the edge of the upper rim 14 of the reflector. By means of contact pressure of the reflector 10 on the first bulb part 13*a*, the first bulb part 13*a* can be clamped between the reflector 10 and the cooling body 6. The first bulb part 13*a* (laterally) covers the light-emitting diodes 2*a* of the first light source group.

The second bulb part 13*b* is implemented as a shell in the form of a spherical cap, which is attached on the upper side 12 of the reflector, preferably there on an outer rim region at the transition to or at the edge of the upper rim 14 of the reflector 10. The second bulb part 13*b* may be snapped, inserted and glued, or latched, etc., into the upper side 12 of the reflector 10, for example. The upper bulb part 13*b* represents the frontmost or uppermost part of the semiconductor lamp, wherein the tip S of the second bulb part, at which the longitudinal axis L intersects the second bulb part 13*b*, corresponds to a front tip of the semiconductor lamp 1. The second bulb part 13*b* covers the at least one light-emitting diode 2*b* of the second light source group.

Before the attachment of the second bulb part 13*b*, in the embodiment shown, the reflector 10 must be fastened by means of three screws as an example here (of which one screw 15 is shown). For this purpose, the reflector 10 has a respective recess 16, which has in its base a screw feedthrough or borehole for guiding through a screw thread of the screw 15. The printed circuit board 4 and the cooling body 6 also have matching screw feedthroughs or passage boreholes (not shown) concentrically to the screw feedthrough of the reflector. The housing 8 has a matching reinforced region 17, in which region a screw thread is introduced concentrically to the feedthroughs or boreholes in the reflector 10, in the printed circuit board 4, and in the cooling body 6. The screw 15 may therefore be guided with its pin-like threaded projection through the base of the reflector 10, the printed circuit board 4, and the cooling body 6 into the matching thread in the housing 8, wherein the head of the screw 15 rests on the reflector 10. This configuration can be provided, in particular rotationally-symmetrically, to the longitudinal axis L. When the screw 15 is tightened, the reflector 10 is drawn toward the housing 8, whereby the printed circuit board 4 and the cooling body 6 are pressed in between. The printed circuit board 4 and the cooling body 6 may firstly be securely fastened by the pressing in and, in addition, good mechanical and thermal contacting is thus achieved between the reflector 10 and the printed circuit board 4 and also between the printed circuit board 4 and the cooling body 6. A corresponding thermal interface material (for example, a thermal conduction film or a thermal conduction paste, etc.) may be introduced between the respective contact surfaces to improve the heat transfer. The first bulb part 13*a* is fixed simultaneously, as described. The entire front part of the semiconductor lamp 1 shown may thus be assembled up to the upper bulb part 13*b* by three screw connections, which are simple to execute and cost-effective. Electrical contacts may optionally also be supplemented.

If the upper bulb part 13*b* is installed irreversibly on the reflector (e.g., clipped, glued, etc.), an end user can no longer open the semiconductor lamp 1 at least in the front bulb region, which produces an increased safeguard against an undesired direct engagement on the light-emitting diodes 2*b*.

The cooling body 6 may absorb a part of the heat generated by the light-emitting diodes 2*a* and 2*b* via the printed circuit board 4. The printed circuit board 4 may be implemented, for example, as a metal core circuit board or alternatively as a ceramic printed circuit board for effective heat spreading. The cooling body 6 must be dimensioned sufficiently for sufficient heat dissipation of the light-emitting diodes 2*a*, 2*b* alone. Because of the semiconductor lamp 1 implemented as a retrofit lamp, however, lengthening of the cooling body 6 is only possible to a limited extent, so that, for example, a reduction of the bulb height and corresponding lengthening of the cooling body 6 and matching widening are only possible toward the front. Thus, however, the front surface of the cooling body 6 is shifted sufficiently forward (in the direction of the longitudinal axis L) that illumination of the lower half space UH also in particular is made much more difficult. An enlargement of the cooling body 6 is therefore at the cost of the spatial angle range which can be reasonably illuminated.

In order to also achieve sufficient cooling at least of the light-emitting diodes 2*a*, 2*b*, optionally also still further components, in the case of the compact cooling body 6, the upper rim 14 of the reflector 10 is designed as a heat dissipation surface or cooling surface. For this purpose, the upper rim 14 is implemented here as a ring-shaped broad rim, in particular in the form of a spherical segment. By means of the upper rim 14 thus designed, heat may easily be dissipated in substantial amounts to the environment, in particular to air enclosing the semiconductor lamp 1. Broad angle room illumination may thus be achieved with good cooling at the same time. The upper rim 14 may be smooth or may be structured for improved heat dissipation. Structuring may include, for example, cooling ribs, cooling pins, etc. Heat may flow both from the light-emitting diodes 2*a*, 2*b* via the printed circuit board 4 onto the reflector 10 and also from heated air within the semiconductor lamp 1.

The reflector 10 is therefore also used as a further cooling body in addition to the cooling body 6. For this purpose, the reflector 10 consists of a material having good heat conductivity, e.g., having aluminum, magnesium, and/or copper or alloys thereof, or of ceramic. In addition, a wall thickness d of the reflector 10 increases. The shape of the reflector 10 may be described, for example, as trumpet-shaped or funnel-shaped. The lower side 11 and the upper side 12 may be paraboloid in profile or cross-section, for example, but are not restricted thereto.

Figure 2:
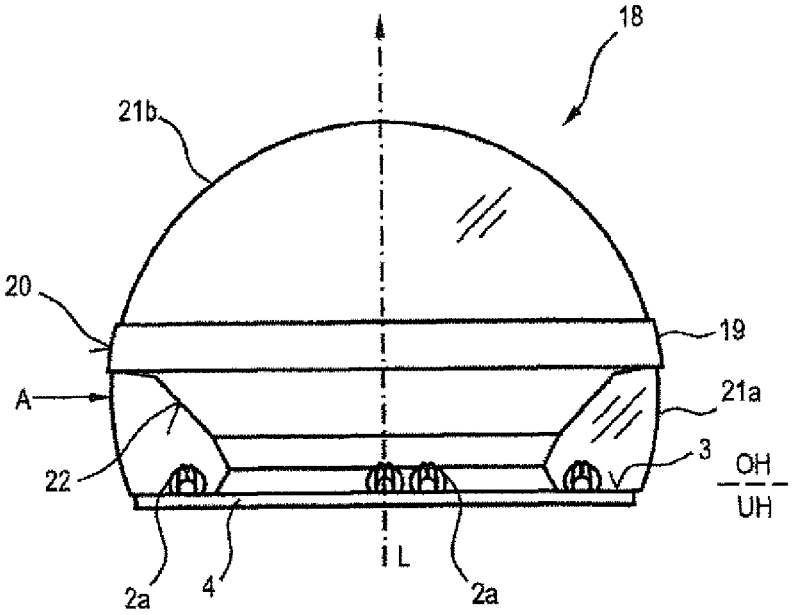
FIG. 2 shows a side view of a semiconductor lamp according to a further embodiment.
Figure 3:
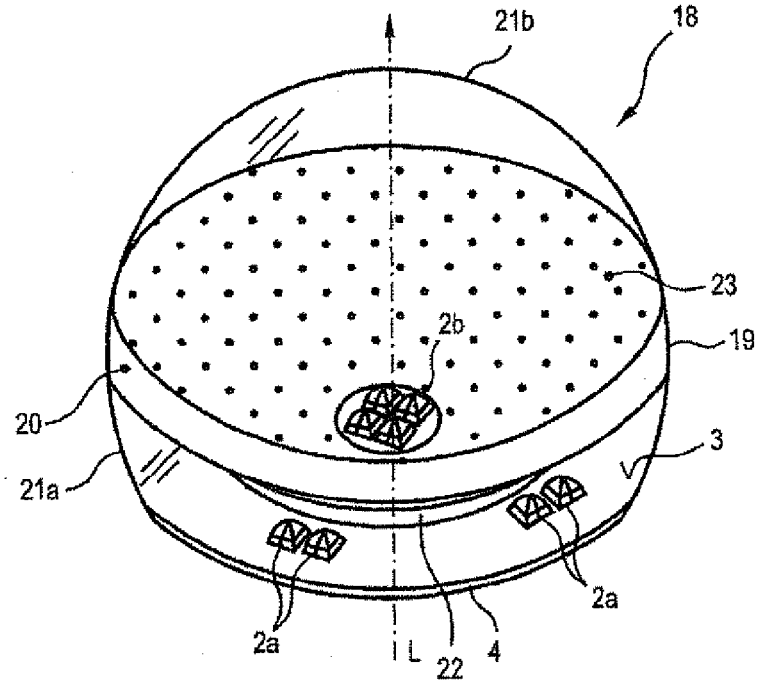
FIG. 3 shows the semiconductor lamp according to the second embodiment in a view diagonally from above.

FIG. 2 shows a side view of a front region of a semiconductor lamp 18 according to a second embodiment, and FIG. 3 shows the region of the semiconductor lamp 18 shown in FIG. 2 in a view diagonally from above.

The semiconductor lamp 18 has, similarly to the semiconductor lamp 1, a reflector 19 which is hollow and open on both sides along a longitudinal axis L, and which is attached on a front side 3 of a printed circuit board 4. The reflector 19 also has a widened upper rim 20 in the form of a spherical segment here, which is used as a heat dissipation surface and which separates a first (lower) bulb part 21*a*, which is provided in the form of a shell shaped like a spherical segment made of light-transmissive material, from a second (upper) bulb part 21*b*, in the form of a light-transmissive shell shaped like a spherical cap. The semiconductor lamp 18 also has light-emitting diodes 2*a*, 2*b* arranged on the front side 3 of the printed circuit board 4, wherein the light-emitting diodes 2*a* are associated with a first light source group and are arranged laterally outside the reflector 19 and irradiate a reflective lower side 22 of the reflector 19, while the (here: four) light-emitting diodes 2*b* of a second light source group are arranged inside the reflector 19 or are peripherally enclosed by the reflector 19 and emit their light partially onto a reflective upper side 23 of the reflector and otherwise emit directly through the second bulb part 21*b*. While the light-emitting diodes 2*b* of the second light source group are attached centrally in a compact arrangement on the printed circuit board 4, the light-emitting diodes 2*a* are arranged in pairs in a ring shape and symmetrically to the longitudinal axis L.

While the upper side 23 of the reflector 19 is smooth, the lower side 22 of the reflector 19 has a traverse-like shape in profile or cross-section. The segment of the lower side 22 associated with the lowermost traverse, which borders directly on the printed circuit board 4, is even inclined in the direction of the longitudinal axis L. Particularly multiform light emission may be achieved by means of the traverse-like design of the lower side 22.

In addition, the first bulb part 21*a* of the semiconductor lamp 18 is designed such that it expands downward (opposite to the direction of the longitudinal axis L) beyond the broadest extension or equator A, so that radiation back into the lower half space UH is made possible in a particularly large spatial angle range.

Both in the case of the semiconductor lamp 1 and also in the case of the semiconductor lamp 18, the light-emitting diodes 2*a* of the first light source group and the light-emitting diodes 2*b* of the second light source group are located on one plane. They may be equipped particularly simply, in particular if they are arranged on the same printed circuit board 4. The simple equipping is also assisted in that the light-emitting diodes 2*a*, 2*b* are arranged on a substantially level surface and therefore not angled to one another.

Figure 4:
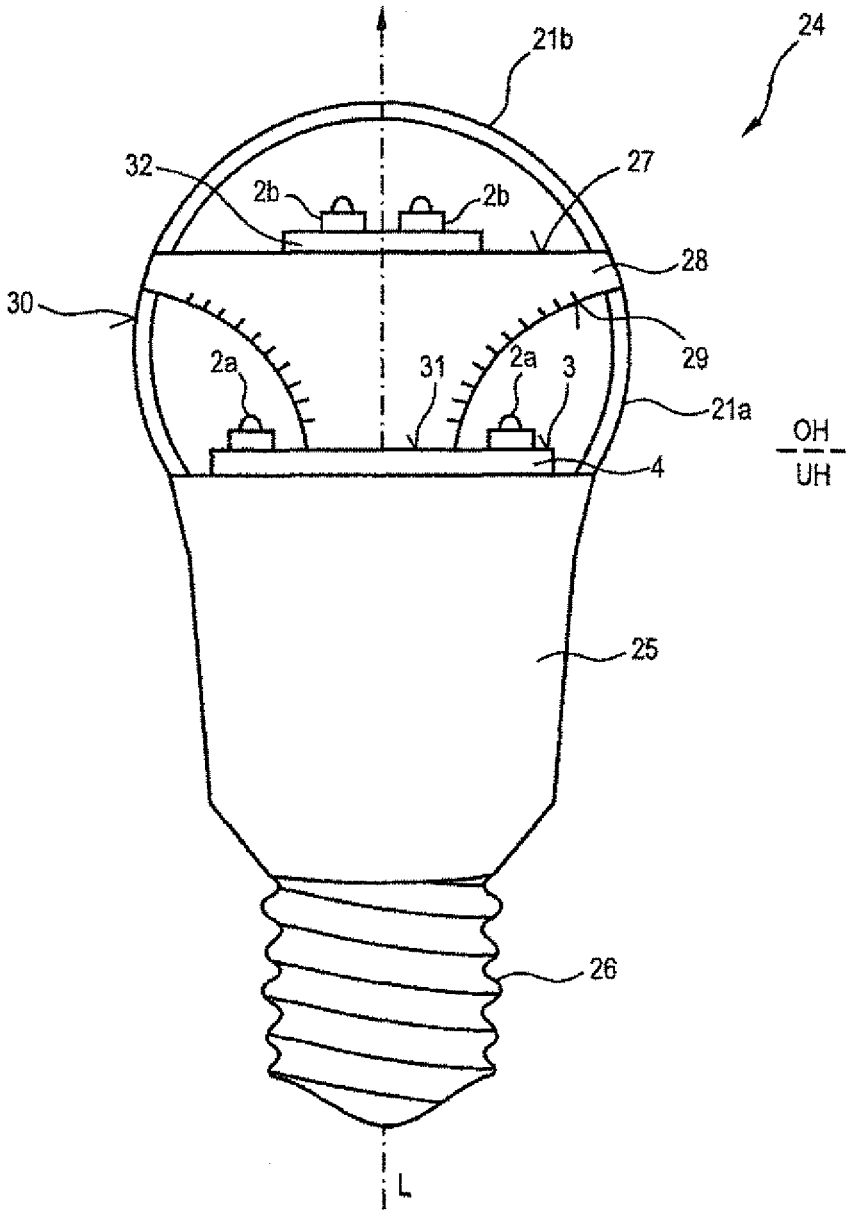
FIG. 4 shows, partially in a side view and partially as a sectional illustration in a side view, a semiconductor lamp according to a third embodiment.

FIG. 4 shows a semiconductor lamp 24 according to a third embodiment. The (main) cooling body 25 and the Edison screw base 26 adjoining it on its lower or rear end are shown in a side view, while the elements frontally adjoining the cooling body 25 are shown in a sectional illustration.

In contrast to the semiconductor lamps 1 and 18, the light-emitting diodes 2*b* of the second light source group are now arranged in front of or above the light-emitting diodes 2*a* of the first light source group. More precisely, while the light-emitting diodes 2*a* are still arranged on the printed circuit board 4 (which is itself fastened on the cooling body 25), the light-emitting diodes 2*b* are arranged, in particular by means of a second printed circuit board, on the upper side 27 of the reflector 28. The reflector 28 may be implemented as a solid body for this purpose, for example, the reflective lower side 29 of which arches over the light-emitting diodes 2*a* of the first light source group or is irradiated thereby, while the upper side 27 may be designed as a level surface, perpendicular to the longitudinal axis L. The upper side 27 and the lower side 29 are again separated from one another by a broad upper rim 30, wherein the upper rim 30 separates the first bulb part 21*a* and the second bulb part 21*b* from one another and represents a heat dissipation surface. The reflector 28 is placed with its footprint 31 on a large area on the front side 3 of the printed circuit board 4.

The light-emitting diodes 2*b* of the second light source group are arranged on a front side of a second substrate in the form of a second printed circuit board 32, e.g., in a ring shape in relation to the longitudinal axis L or in a matrix, wherein the second printed circuit board 32 rests with its rear side flatly on the reflector 28. The upper side 27 does not need to be mirrored, but may be. In the case of the semiconductor lamp 24, the light-emitting diodes 2*a* and 2*b* are therefore arranged on different planes.

Since the reflector 28 no longer has to enclose the light-emitting diodes 2*b*, its contact surface, which is determined by its footprint 31, with the printed circuit board 4 is substantially larger than in the case of the semiconductor lamps 1 and 18. Therefore, heat conduction from the light-emitting diodes 2*a* of the first light source group into the reflector 28, which is also used as a cooling body, may be strengthened. The cooling body 25 may be used for heat dissipation from the light-emitting diodes 2*a* and optionally also 2*b*.

In a refinement, the light-emitting diodes 2*b* may be cooled substantially only by the reflector 28. A variant is therefore also possible in which the heat dissipation of the light-emitting diodes 2*a* of the first light source group substantially occurs via the (main) cooling body 25 and the heat dissipation from the light-emitting diodes 2*b* of the second light source group occurs via the reflector 28, which is also used as a cooling body. In this case, for example, in particular provision of a heat transfer material or a thermal interface material between the reflector 28 and the printed circuit board 4 may be omitted. The cooling body 25 is then relieved from heat dissipation of the light-emitting diodes 2*b* and can accordingly be embodied as smaller.

Alternatively, the reflector may also be arranged floating over the light-emitting diodes 2*a* and/or 2*b*.

Figure 5:
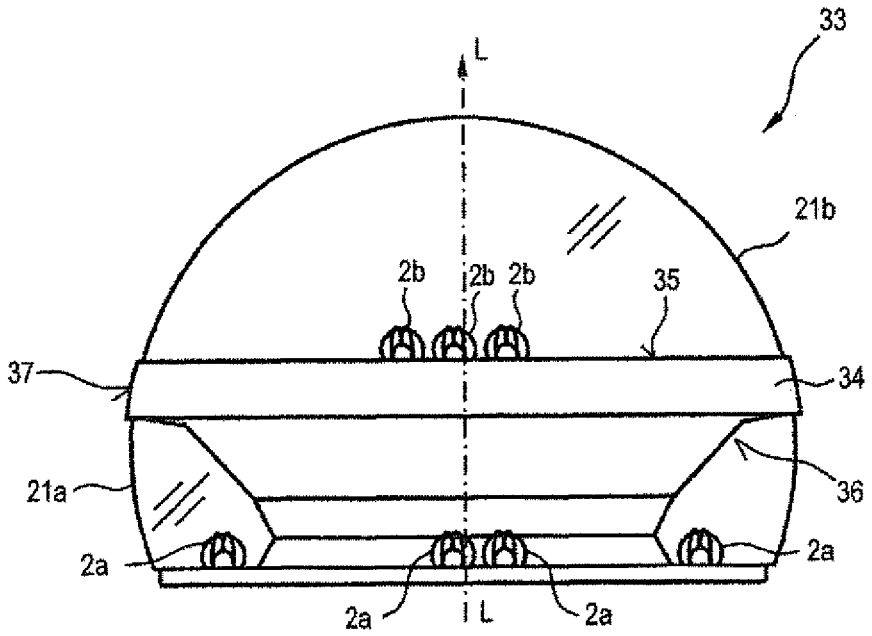
FIG. 5 shows a detail of a semiconductor lamp according to a fourth embodiment.

FIG. 5 shows an upper part of a semiconductor lamp 33 according to a fourth embodiment similar to the semiconductor lamp 18, wherein the reflector 34 is now implemented as a solid body, however, on the planar upper side 35 of which the light-emitting diodes 2*b* of the second light source group are arranged. The lower side 36 is also implemented similarly here to the lower side 22 as traverse-like in profile, and the upper side 35 and the lower side 36 are separated from one another by an external broad upper rim 37 of the reflector 34. The reflector 34 also consists here of a material having good heat conductivity, e.g., including aluminum, magnesium, and/or copper or ceramic, so that it is used as an additional cooling body.

Figure 6:
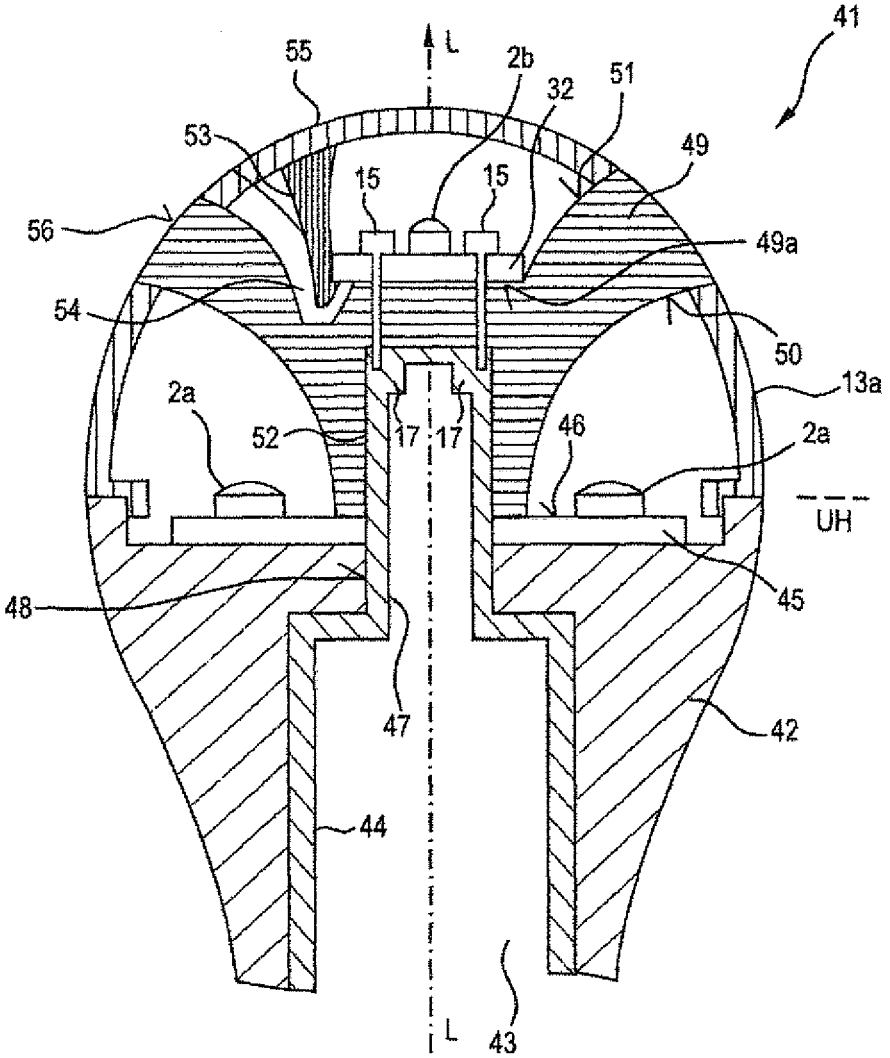
FIG. 6 shows a sectional illustration in a side view of a semiconductor lamp according to a fifth embodiment.

FIG. 6 shows a semiconductor lamp 41 as a sectional illustration in a side view. The semiconductor lamp 41 has a (main) cooling body 42 having a driver cavity 43, wherein the driver cavity 43 is provided and configured to accommodate a driver and is lined by means of an electrically insulating housing 44. A printed circuit board 45 is attached with its rear side in a flat and thermally conductive manner on a planar front side of the cooling body 42, while the front side 46 of the printed circuit board 45 is equipped in a ring shape with light-emitting diodes 2*a* of the first light source group. The printed circuit board 45 is itself implemented as ring-shaped, wherein a tubular projection 47 of the housing 44, which protrudes forward, protrudes through a central opening of the printed circuit board 45. The cooling body 42 has a central feedthrough opening 48 for guiding the projection 47 through the cooling body 42. The projection 47, the printed circuit board 45, and the feedthrough opening 48 are implemented concentrically to the longitudinal axis L of the semiconductor lamp 41.

A reflector 49 having a broad upper rim 56 is also attached here on the front side 46 of the printed circuit board 45 and arches over the light-emitting diodes 2*a* of the first light source group such that their light is partially deflected to an increased extent laterally and into the lower half space UH. For this purpose, a reflective lower side 50 of the reflector 49 is embodied as curved here, for example, but can also be provided in the form of traverse regions and/or facets. As already in the case of the semiconductor lamp 1, the light-emitting diodes 2*a* of the first light source group are laterally covered by a first bulb part 13*a*, which is fixed in a clamped or pressed manner in the assembled state between the cooling body 42 and the reflector 49.

In contrast to the semiconductor lamp 1, the at least one light-emitting diode 2*b* of the second light source group is now arranged or attached on an upper side 51 of the reflector 49 via a second printed circuit board 32 in the direction of the longitudinal axis L. More precisely, the upper side 51 has a central level region 49*a*, on which the rear side of the printed circuit board 32 can be placed flatly, optionally via a thermal interface material. The lateral region of the upper side 51, in contrast, is implemented as widening outward similarly to the upper side 12 of the semiconductor lamp 1. The light emitted by the light-emitting diodes 2*b* may therefore be partially reflected from the upper side 51 of the reflector 49. The light-emitting diodes 2*b* of the second light source group are arranged further to the front or upward than the light-emitting diodes 2*a* of the first light source group, so that the two light source groups or their light-emitting diodes 2*a*, 2*b* are arranged on different planes in relation to the longitudinal axis L.

The reflector 49 also has a rear receptacle opening 52, which is centered in relation to the longitudinal axis L, for receiving the section of the projection 47 of the housing 44 which projects beyond the printed circuit board 45. The reflector 49 can thus be fastened on the projection 47 and positioned by means thereof.

For the assembly, for example, the housing 44 can be inserted rearward into the driver cavity 43 of the cooling body 42, so that the projection 47 protrudes forward through the passage opening 48. The ring-shaped printed circuit board 45 may then be plugged onto the projection 47 and placed on the front side of the cooling body 42, preferably via a thermal interface material, for example, a thermal conduction film, for the mechanical and thermal contacting. The first bulb part 13*a* may then be placed on a lateral rim region of a front side of the cooling body 42. The reflector 49 may be plugged with its receptacle opening 52 on the projection 47 as the next step. The light-emitting diodes 2*b* may already be fastened with the printed circuit board 32 on the reflector 49, or the printed circuit board 32 having the light-emitting diodes 2*b* equipped thereon can be placed in a following step on the upper side 51. Screws 15 may then be introduced through corresponding passage openings or boreholes in the second printed circuit board 32 and in the reflector 49 up to matching counter-threads in the projection 47, more precisely in reinforced regions 17 of the projection 47, and screwed in. The second printed circuit board 32 and the housing 44 are drawn toward one another by the screw connection, upon which the interposed reflector 49, the (first) printed circuit board 45, and the cooling body 42 are pressed together between them and with one another. Particularly simple and solid assembly of the described elements is thus achieved. In addition to secure mechanical fixing, low heat transfer resistance between them is also made possible.

To fix the second bulb part 55, it can be placed on the reflector 49 and latched with the second printed circuit board 32. For this purpose, the second bulb part 55 has an inwardly directed catch hook 53, which may be inserted into a corresponding catch recess 54 of the reflector 49. The catch recess 54 includes an undercut of the reflector 49 in the region of the second printed circuit board 32, so that the catch hook 53 can engage behind the second printed circuit board 45 for the latching.

Figure 7:
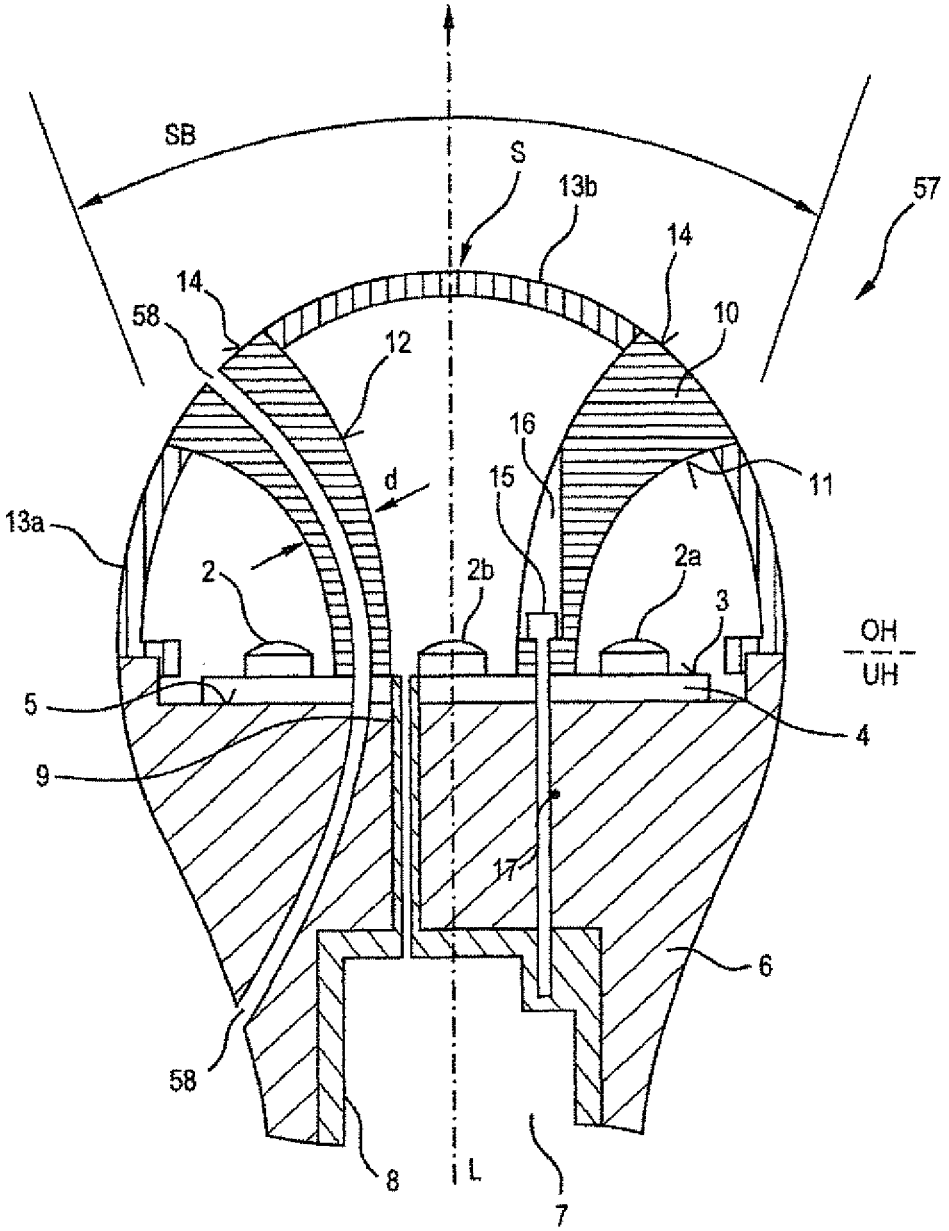
FIG. 7 shows a sectional illustration in a side view of a semiconductor lamp according to a sixth embodiment.

FIG. 7 shows a semiconductor lamp 57 according to a sixth embodiment as a sectional illustration in a side view. The semiconductor lamp 57 substantially corresponds to the semiconductor lamp 1, except that the semiconductor lamp 57 now has cooling channels 58, of which one cooling channel 58 is shown as an example here. The cooling channels 58 are in particular open to the outside on both sides, so that cooling air can flow through them. In the present embodiment, the cooling channels 58 are arranged substantially vertically and lead through the cooling body 6, through the printed circuit board 4, and further through the reflector 10, which elements 4, 6, 10 have corresponding feedthroughs, in particular boreholes, arranged in a matching fashion as channel sections. Alternatively, the reflector 10 may also be seated directly on the cooling body 6 and may form the cooling channel 58 together therewith.

Figure 8:
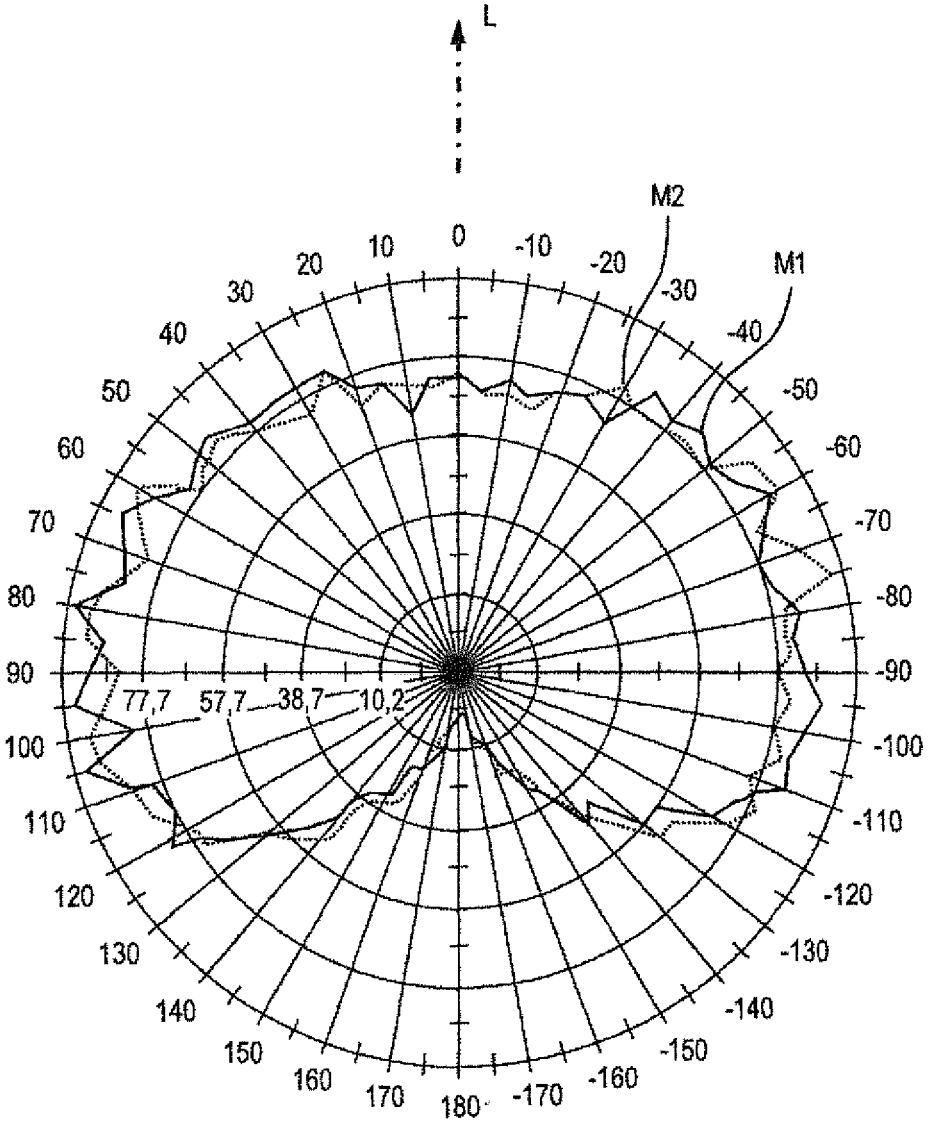
FIG. 8 shows a polar angle diagram of a luminosity distribution of a semiconductor lamp.

FIG. 8 shows a polar angle diagram of a luminosity distribution of a semiconductor lamp according to the invention, for example, a semiconductor lamp 1, 18, 24, 33, 41, or 57 having two measurements M1 (solid line) and M2 (dashed line). The luminosity distribution at a specific polar angle is significant up to approximately 160° and is substantially homogeneous for practical purposes up to approximately 125°.

Of course, the present invention is not restricted to the exemplary embodiments shown.

The bulb parts and/or the reflector may thus be equipped with at least one illuminant for wavelength conversion.

The reflector may also arch over the light-emitting diodes of the first light source group only partially or not at all, but the reflector may be arranged laterally (in horizontal projection) with respect to this/these light-emitting diode(s).

Very generally, the reflector may be seated directly on the cooling body (i.e., not only on the printed circuit board or the substrate), optionally via a thermal interface material (TIM). The substrate may then be designed in a ring shape, for example, or the reflector can be enclosed by individual circuit boards.

While the semiconductor light sources shown are usable in particular as incandescent lamp-retrofit lamps, the invention is restricted neither thereto nor to retrofit lamps.

The reflector may have matching cable guides, e.g., passage channels, in particular if the second light source group is attached thereon, so that the second light source group and/or the second substrate are electrically connectable, in particular to a driver arranged in the driver cavity.

LIST OF REFERENCE NUMERALS

1 semiconductor lamp
2*a* light-emitting diode
2*b* light-emitting diode
3 front side of the printed circuit board
4 printed circuit board
5 rear side of the printed circuit board
6 cooling body
7 driver cavity
8 housing
9 projection of the housing
10 reflector
11 lower side of the reflector
12 upper side of the reflector
13*a* first bulb part
13*b* second bulb part
14 upper rim of the reflector
15 screw
16 recess of the reflector
17 reinforced region of the housing
18 semiconductor lamp
19 reflector
20 upper rim of the reflector
21*a* first bulb part
21*b* second bulb part
22 lower side of the reflector
23 upper side of the reflector
24 semiconductor lamp
25 cooling body
26 Edison screw base
27 upper side of the reflector
28 reflector
29 lower side of the reflector
30 upper rim
31 footprint
32 second printed circuit board
33 semiconductor lamp
34 reflector
35 upper side of the reflector
36 lower side of the reflector
37 upper rim
41 semiconductor lamp
42 cooling body
43 driver cavity
44 housing
45 printed circuit board
46 front side of the printed circuit board
47 projection of the housing
48 feedthrough opening
49 reflector
49*a* level region
50 lower side of the reflector
51 upper side of the reflector
52 receptacle opening
53 catch hook
54 catch recess
55 second bulb part
56 upper rim of the reflector
57 semiconductor lamp
58 cooling channel
A equator
L longitudinal axis
M1 measurement
M2 measurement
S tip
OH upper half space
SB shaded region
UH lower half space

The invention claimed is:

1. A semiconductor lamp, comprising a reflector having a lower side and an upper side, wherein the lower side widens laterally and wherein the lower side and the upper side are separated from one another by an upper rim, and having a first light source group having at least one semiconductor light source and a second light source group having at least one semiconductor light source, wherein the reflector is provided as a cooling body for the first light source group and for the second light source group;

wherein at least a part of a light that can be emitted by the first light source group can be reflected by means of the lower side of the reflector at least into a spatial angle range that cannot be directly illuminated by the first light source group, wherein the second light source group is configured for the purpose of illuminating at least in part via reflection from the upper side of the reflector at least one shaded region of the reflector in relation to the first light source group, and at least one shaded region of the reflector in relation to the first light source group, and wherein the upper rim of the reflector is designed as a cooling surface, wherein the semiconductor lamp has a two-part light-transmissive bulb having a first bulb part and a second bulb part, wherein the first bulb part covers the first light source group and the second bulb part covers the second light source group, and the first bulb part and the second bulb part are separated from one another by the upper rim of the reflector.

2. The semiconductor lamp as claimed in claim 1, wherein the upper rim is implemented as a broad rim at least in the form of a ring sector.

3. The semiconductor lamp as claimed in claim 1, wherein the second bulb part can be latched with the reflector.

4. The semiconductor lamp as claimed in claim 3, wherein the second bulb part has a catch hook, which can be latched behind the second substrate.

5. The semiconductor lamp as claimed in claim 3, wherein the cooling body has a driver cavity which is lined with an electrically insulating housing, wherein the housing protrudes through the cooling body and through the first substrate up to the reflector, and the second substrate is connected with the housing through the reflector.

6. The semiconductor lamp as claimed in claim 1, wherein the semiconductor lamp has a first substrate, wherein the reflector and at least the first light source group are arranged on a front side of the first substrate.

7. The semiconductor lamp as claimed in claim 1, wherein the second light source group is arranged on the upper side of the reflector.

8. The semiconductor lamp as claimed in claim 7, wherein the semiconductor lamp has a second substrate, wherein the second light source group is arranged on a front side of the second substrate, and the second substrate is fastened with its rear side on the reflector.

9. The semiconductor lamp as claimed in claim 7, wherein the semiconductor lamp has a second printed circuit board, wherein the second light source group is arranged on a front side of the second printed circuit board, and the second printed circuit board is fastened with its rear side on the reflector.

10. The semiconductor lamp as claimed in claim 1, wherein the reflector is hollow and open on both sides in the longitudinal direction, and the second light source group is laterally enclosed by the reflector.

11. The semiconductor lamp as claimed in claim 1, wherein the rear side of the first substrate is attached on a cooling body, the cooling body has a driver cavity lined with an electrically insulating housing, and the reflector is screwed together with the housing through the printed circuit board and through the cooling body.

12. The semiconductor lamp as claimed in claim 1, wherein the first light source group has a plurality of semiconductor light sources, which are arranged in a ring shape around the reflector.

13. The semiconductor lamp as claimed in claim 1, wherein the semiconductor lamp is a retrofit lamp.

14. The semiconductor lamp as claimed in claim 1, wherein at least the reflector has at least one cooling channel.

15. The semiconductor lamp as claimed in claim 1, wherein the semiconductor lamp has a first printed circuit board, wherein the reflector and at least the first light source group are arranged on a front side of the first printed circuit board.

16. The semiconductor lamp as claimed in claim 1, wherein the semiconductor lamp is an incandescent lamp-retrofit lamp.

17. A semiconductor lamp, comprising a reflector having a lower side and an upper side, wherein the lower side widens laterally and wherein the lower side and the upper side are separated from one another by an upper rim, and having a first light source group having at least one semiconductor light source and a second light source group having at least one semiconductor light source, wherein the reflector is provided as a cooling body for the first light source group and for the second light source group;

wherein at least a part of a light that can be emitted by the first light source group can be reflected by means of the lower side of the reflector at least into a spatial angle range that cannot be directly illuminated by the first light source group, wherein the second light source group is configured for the purpose of illuminating at least in part via reflection from the upper side of the reflector at least one shaded region of the reflector in relation to the first light source group, and at least one shaded region of the reflector in relation to the first light source group, and wherein the upper rim of the reflector is designed as a cooling surface, and wherein the upper rim has a surface in contact with an inner-side surface of a one-piece bulb.

* * * * *